US010112095B2

(12) United States Patent
Serowik

(10) Patent No.: US 10,112,095 B2
(45) Date of Patent: Oct. 30, 2018

(54) SPORTS TRAINING DEVICE

(71) Applicant: Mr. Assist LLC, Westwood, MA (US)

(72) Inventor: Jeff Serowik, Dover, MA (US)

(73) Assignee: Mr. Assist LLC, Westwood, MA (US)

( * ) Notice: Subject to any disclaimer, the term of this patent is extended or adjusted under 35 U.S.C. 154(b) by 0 days.

(21) Appl. No.: 15/406,075

(22) Filed: Jan. 13, 2017

(65) Prior Publication Data

US 2017/0197131 A1 Jul. 13, 2017

Related U.S. Application Data

(60) Provisional application No. 62/278,069, filed on Jan. 13, 2016.

(51) Int. Cl.
*A63B 69/00* (2006.01)

(52) U.S. Cl.
CPC ..... *A63B 69/0026* (2013.01); *A63B 69/00* (2013.01); *A63B 69/0024* (2013.01)

(58) Field of Classification Search
CPC . A63B 59/70; A63B 69/0088; A63B 69/0026; A63B 67/20; A63B 69/00; A63B 67/14
USPC ..... 473/422, 425, 424, 423, 438, 446
See application file for complete search history.

(56) References Cited

U.S. PATENT DOCUMENTS 3,081,578 A * 3/1963 Mosher ..... A63H 1/30 446/216
3,863,917 A * 2/1975 Beale ..... A63B 67/20 473/425
4,111,419 A * 9/1978 Pellegrino ..... A63B 67/14 473/425
5,120,055 A * 6/1992 McCarthy ..... A63B 59/70 473/425
5,389,029 A * 2/1995 McAvoy, Jr. ..... A63H 1/30 446/250
5,512,028 A * 4/1996 Sparks, III ..... A63B 21/0004 446/253
5,816,945 A * 10/1998 Todd ..... A63B 69/0026 473/425
6,217,468 B1 * 4/2001 Goodwin ..... A63B 67/14 473/588
6,776,680 B2 * 8/2004 Chow ..... A63H 1/32 446/247

(Continued)

FOREIGN PATENT DOCUMENTS

GB 2132100 A * 7/1984 ..... A63H 1/30

*Primary Examiner* — Mitra Aryanpour
(74) *Attorney, Agent, or Firm* — Nelson Mullins Riley & Scarborough LLP; Anthony A. Laurentano

(57) ABSTRACT

A sports training device has a circular main housing having opposed top and bottom surfaces each having a plurality of bosses formed thereon, a channel formed within an intermediate housing section of the main housing and extending therethrough, and a fastening mechanism seated within the channel and secured to the main housing by a fastener. The fastener mechanism can include a first fastener part and a separate and independent second fastener part that can be coupled together. The training device also includes a cord element having a first end portion mounted between the first fastener part and the second fastener part and being mechanically retained therebetween, wherein the cord element extends outwardly from the channel.

5 Claims, 3 Drawing Sheets

(56) References Cited

U.S. PATENT DOCUMENTS

| | | | | |
|---|---|---|---|---|
| 6,896,576 | B1 * | 5/2005 | VanKuiken | A63H 1/30 446/245 |
| D524,878 | S * | 7/2006 | Kort | D21/464 |
| 8,157,676 | B2 * | 4/2012 | Cobham | A63B 69/0026 473/422 |
| 8,439,773 | B2 * | 5/2013 | Silagy | A63B 69/0071 473/422 |
| 8,814,626 | B2 * | 8/2014 | Smith | A63H 1/30 446/249 |
| 2006/0063615 | A1 * | 3/2006 | Richardson | A63B 69/0026 473/446 |

* cited by examiner

SPORTS TRAINING DEVICE

RELATED APPLICATION

The present patent application claims priority to the prior filed provisional patent application Ser. No. 62/278,069, entitled SPORTS TRAINING DEVICE, and filed on Jan. 13, 2016, the contents of which are herein incorporated by reference.

FIELD OF THE INVENTION

The present invention relates to the field of sports training devices, and more particularly relates to a hockey training apparatus for enhancing a hockey player's skills in the art of stick handling, passing, and receiving.

BACKGROUND OF THE INVENTION

Sports today have become increasingly complex and specialized and the players that participate in modern day sports are generally highly skilled. Amongst the many sports played today, hockey has become highly specialized and requires specialized skills to play at all levels. One specialized skill relates to the ability to control a game element (e.g. a puck or a ball) during play, also known as stick handling. Stick handling involves the manipulation of a hockey stick to control the game element as the hockey player moves about on the playing surface. For example, by moving an ice hockey stick when playing ice hockey, a hockey player can use the blade of the stick to control the movement of a puck on the ice surface. Stick handling is generally an important skill for shooting, passing, receiving, and generally controlling possession of the game element.

According to some stick handling techniques, hockey players are taught to use their upper hand as a control hand to control the angle and rotational position of the blade of the hockey stick to move the puck or ball, while the lower hand is used as a directional hand to change the overall orientation of the stick without rotating the stick. There is a need in the art for improved apparatus and methods for training hockey players.

Conventional hockey training devices exist in the art and take many forms. The hockey training devices can include for example hockey nets with selected barriers formed thereon in the shape of a goalie to help players practice their shooting skills. Other devices include hockey pucks with selected features that players can use during practice as well as specialized sticks for use in stick handling drills.

In the past, it has been recognized that there exists a need for an apparatus or device to facilitate the very real needs of a hockey player to enhance the player's skills in the art of stick handling, passing, and receiving, and to improve the reflexes of the player when manipulating a hockey puck for controlling the puck with speed and accuracy. However, most conventional hockey training devices are not designed for improving reflex action but more particularly address goal shooting and are usually complicated devices.

Therefore, there exists a need in the art for a compact, simple hockey training device for enhancing a hockey player's skills in the art of stick handling, passing and receiving, and to improve their hockey puck control with speed and accuracy.

SUMMARY OF THE INVENTION

The present invention is directed to a sports training device that can be attached to a sports device, such as a hockey stick, and can be manipulated by the user to practice selected training activities and hence enhance selected skills, such as stick handling.

The sports training device of the present invention includes a circular main housing having opposed top and bottom surfaces each having a plurality of bosses formed thereon, a channel formed within an intermediate housing section of the main housing and extending therethrough, and a fastening mechanism seated within the channel and secured to the main housing by a fastener. The fastener mechanism can include a first fastener part and a separate and independent second fastener part that can be coupled together. The training device also includes a cord element having a first end portion mounted between the first fastener part and the second fastener part and being mechanically retained therebetween, wherein the cord element extends outwardly from the channel.

The main housing of the sports training device of the present invention also includes a first housing section forming the top surface and a second housing section forming the bottom surface, wherein the intermediate section is disposed between the first and second housing sections, and wherein the intermediate housing section is composed of first and second intermediate components. The main housing has a fastener receiving aperture formed therein and the first fastener part and the second fastener part also each have a fastener receiving aperture formed therein. When the first and second fastener parts are mounted within the channel, the fastener receiving apertures of the main housing and the first and second fastener parts are disposed in registration with each other for receiving a fastener for retaining and securing the first and second fastener parts within the channel.

The first fastener part comprises a main body having a first end that includes a first skirt portion and an opposed second end that has a second skirt portion that forms a lip portion, wherein the lip portion projects in a direction opposite to a projection direction of first skirt portion, and a cut-out portion that forms an outwardly projecting tab. The second fastener part comprises a main body having a first end that includes a first skirt portion and an opposed second end that has a skirt portion that forms a lip, wherein the lip portion projects in a direction opposite to a projection direction of the first skirt portion, and a pair of cut-out portions that form a pair of outwardly projecting tabs that are axially spaced apart along the main body.

According to another aspect, each of the first skirt portions of the first fastener part and the second fastener part includes a pair of prong like projections. Further, the outwardly projecting tab of the first fastener part is disposed between the pair of outwardly projecting tabs of the second fastener part when the first and second fastener parts are mounted together within the channel of the main housing.

BRIEF DESCRIPTION OF THE DRAWINGS

Further features and advantages of the present invention will become apparent from the following detailed description, taken in combination with the appended drawings, in which.

DETAILED DESCRIPTION

Figure 1:
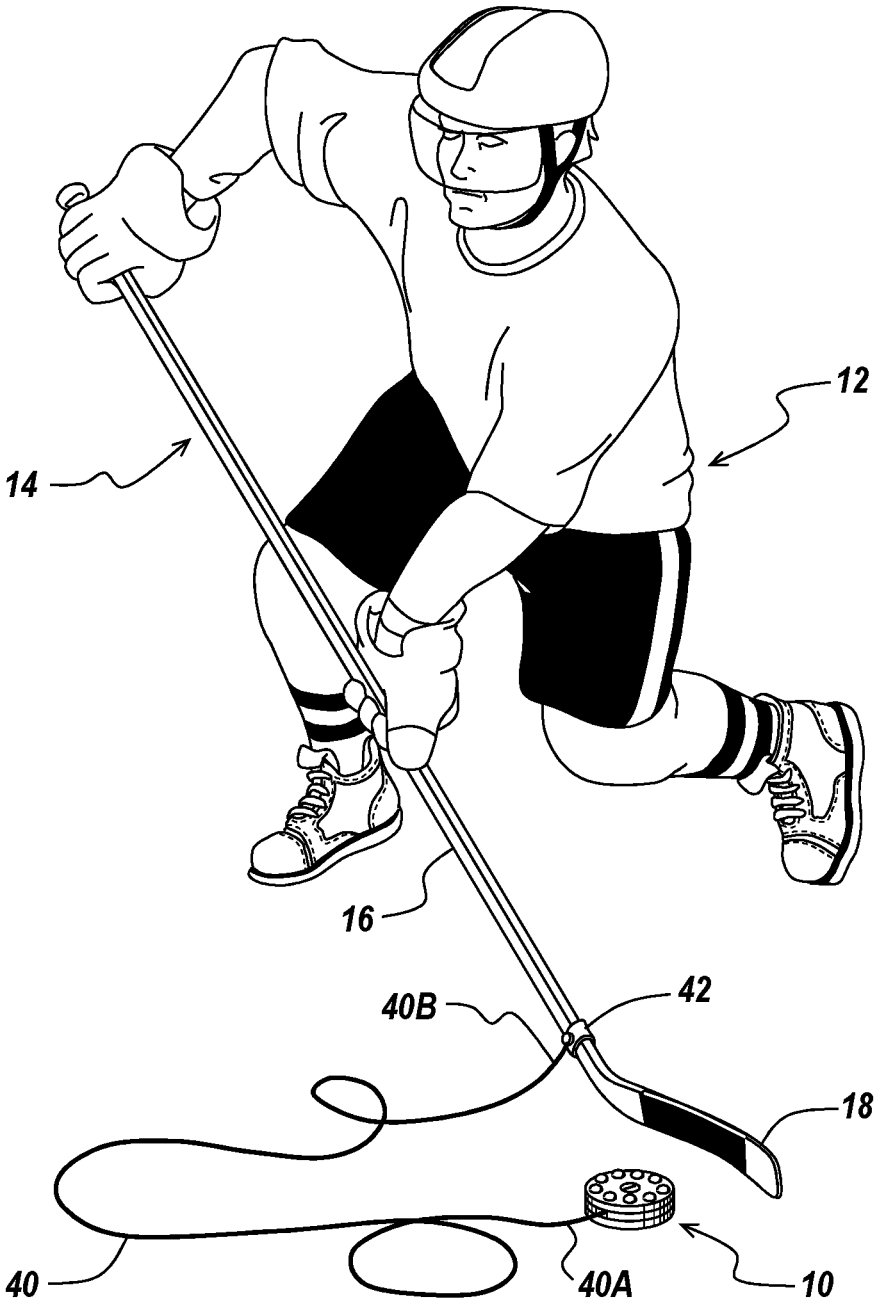
FIG. 1 is a schematic representation of a hockey player with a hockey stick utilizing the hockey training device of the present invention.

The present invention is directed to a sports training device, and particularly to a hockey training device 10 that is used by a player to improve their individual hockey skills, such as for example their passing, receiving and stick handling skills. The hockey training device of the present invention also helps improve the player's reflexes by allowing the player to practice controlling a game element, such as a hockey puck, with speed and accuracy. The hockey training device is typically used on a variety of suitable surfaces other than ice (e.g., off-ice), such as on concrete, asphalt, and other known and traditional surfaces, although if desired, the device can also be used on ice surfaces. FIG. 1 shows a sports player, such as a hockey player 12, that employs a sports device, such as a conventional hockey stick 14, to manipulate the hockey training device 10. The hockey stick 14 includes a main shaft portion 18 and an integrated blade portion 18. The hockey training device 10 is preferably coupled to a bottom portion of the shaft 16 of the hockey stick 14, as illustrated. Once coupled thereto, the player 12 can manipulate the hockey training device in an effort to practice and hence improve their passing, receiving and stick handling skills.

The hockey training device is shown in further detail in FIGS. 2-5. The hockey training device 10 has a main housing 20 that is formed of three sections or parts, including a first housing part 22, a second housing part 24, and an intermediate housing part 26. Alternatively, the main three housing sections can be integrated or secured together to form a single unitary housing unit. The first and second housing parts 22, 24 can each have a plurality of optional bosses 28 that are formed on an exterior surface thereof. For example, the exterior surface 32 of the first housing part 22 (which can form the top or bottom of the hockey training device during use) includes a plurality of bosses 28 that are arranged generally in a circle on the exterior surface. The bosses assist the device in sliding along the playing surface by reducing the total device surface area in actual contact therewith. Likewise, the exterior surface 34 of the second housing part 24 also includes a plurality of bosses 28 that are arranged generally in a circle thereon. Those of ordinary skill in the art will readily recognize that any selected number of bosses can be employed and can be arranged in any particular pattern. Further, and optionally, the exterior surfaces of the first and second housing parts can be devoid of bosses, thus allowing the exterior surfaces themselves to contact the playing surface.

The illustrated main housing 20 further includes an intermediate section or part 26 that has a central passage or channel 30 formed therein, thus essentially splitting the intermediate part into a pair of intermediate subparts 26A, 26A that are similarly shaped. The central channel 30 is thus formed or defined by the housing parts 22, 24 and 26 when assembled together. The channel 30 extends completely through the housing 20. The exterior circumferential surface 36 of the sub-parts can include a textured surface, such as knurling, so as to form a grippable surface. The textured surface can be formed on all three housing parts or only on selected housing parts, such as on the intermediate housing part. The first, second and intermediate housing sections or parts that form the main housing 20 can be secured together by known techniques, such as by a suitable adhesive. When assembled together, the housing parts form the shape of a hockey puck. Those of ordinary skill in the art will readily recognize that the main housing can also be formed if desired as a fully integrated unit with arbitrarily defined sections rather than parts, where the channel 30 is simply formed into the unitary piece.

Figure 2:
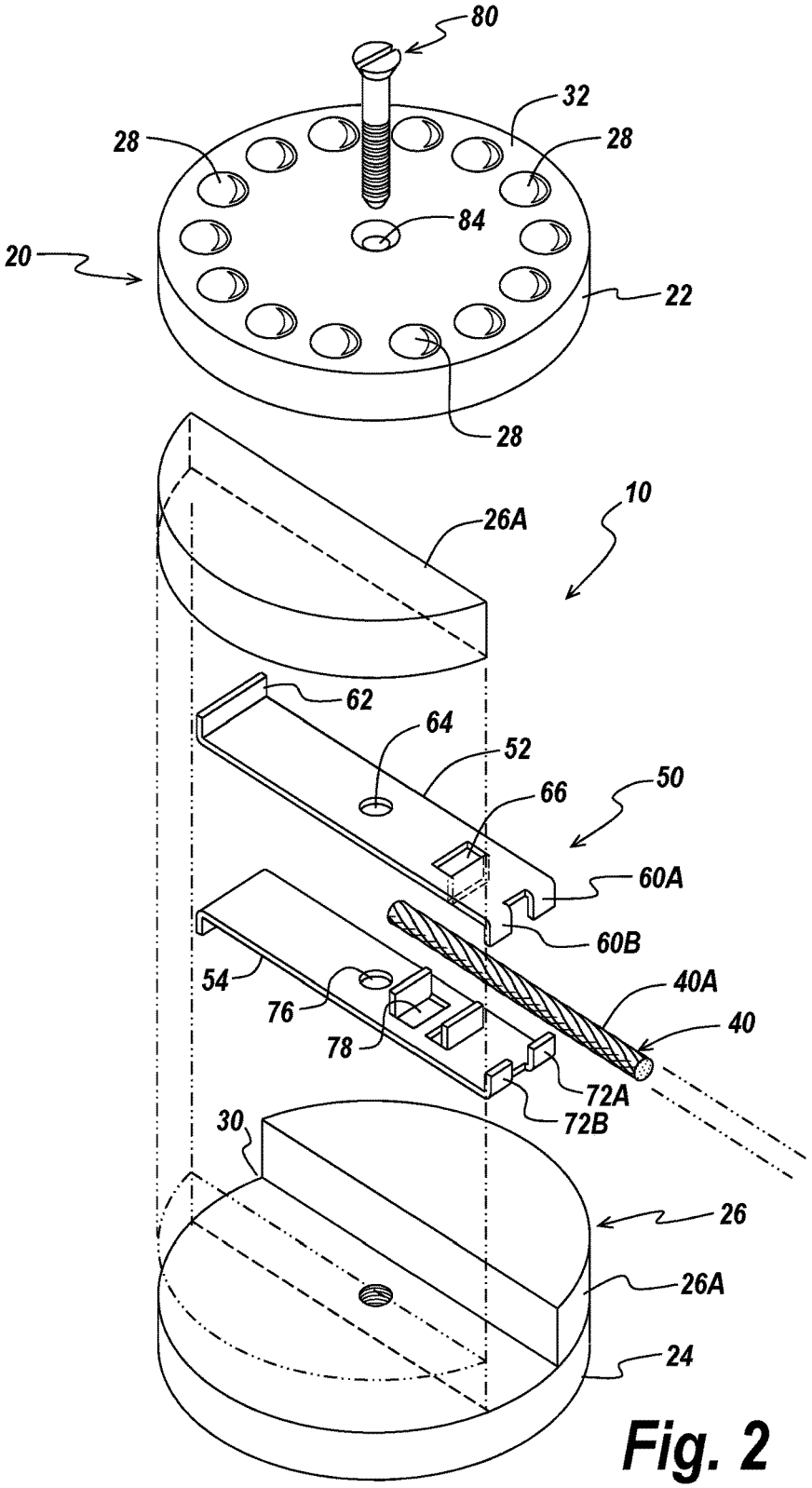
FIG. 2 is an exploded schematic view of the hockey training device according to the teachings of the present invention.
Figure 3:
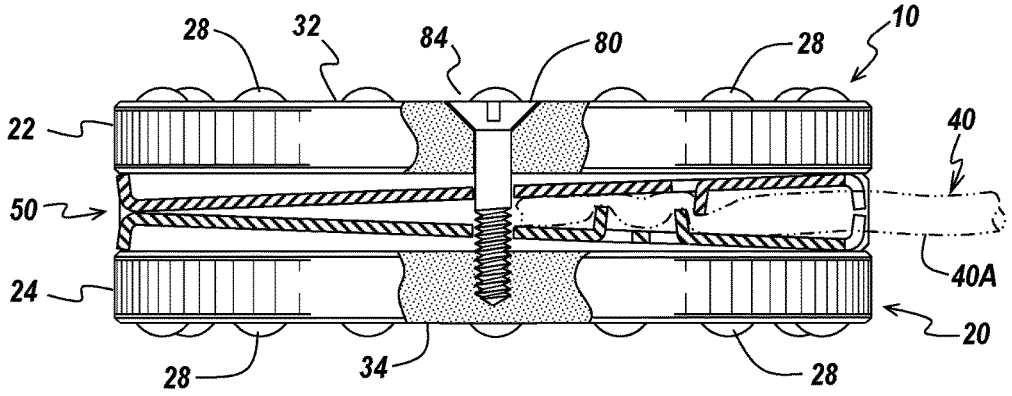
FIG. 3 is an assembled side view of the hockey training device of FIG. 2 according to the teachings of the present invention.
Figure 4:
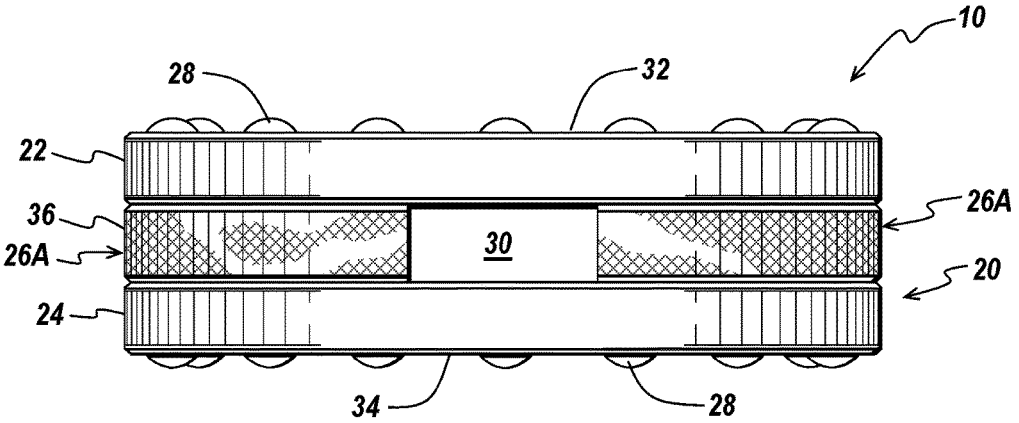
FIG. 4 is a side view of the main housing of the hockey training device according to the teachings of the present invention.
Figure 5:
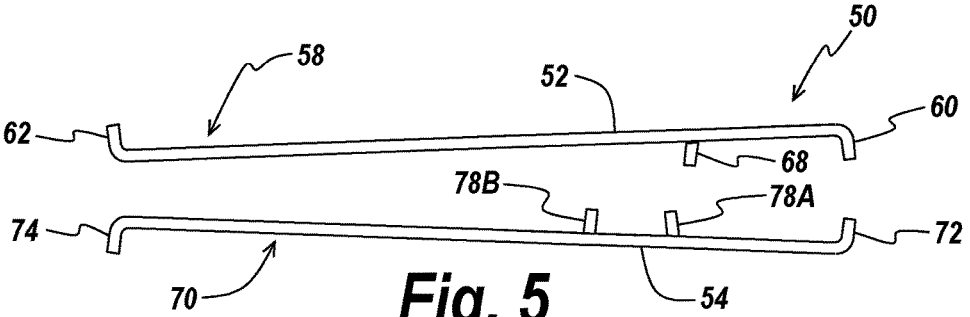
FIG. 5 is a perspective view of the fastening mechanism of the hockey training device according to the teachings of the present invention.

As shown in FIGS. 2, 3 and 5, the hockey training device 10 further includes a first fastening mechanism 50 that is mounted in and secured to the channel 30. The first fastening mechanism 50 includes a first fastening element 52 and a second fastening element 54. The first and second fastening elements when used together help secure a flexible cable or cord 40 to the main housing 20. The cord 40 is configured to be mechanically retained between the first and second fastening elements 52, 54, and the fastening elements are sized and configured to be mounted within the channel 30 formed in the main housing 20. The fastening elements 52, 54 can be retained and secured within the housing by a fastener 80.

The illustrated first fastening element 52 has a main body 58 having a first end that includes a skirt like portion 60, which can be preferably formed as a pair of prong like projections 60A, 60B. The main body 58 also includes an opposed second end that has a skirt like portion that forms a lip 62. According to one practice, the lip portion 62 projects in a direction opposite to the projection direction of the prong like projections 60A, 60B. The main body 58 of the first fastening element 52 also includes a central aperture 64 that is adapted to seat a portion of the fastener 80. The main body also includes a cut-out portion 66 that forms an outwardly projecting tab 68.

Similarly, the illustrated second fastening element 54 has a main body 70 having a first end that includes a skirt like portion 72 that is preferably formed as a pair of prong like projections 72A, 72B. The main body 70 also includes an opposed second end that has a skirt like portion that forms a lip 74. According to one practice, the lip portion 74 projects in a direction opposite to the projection direction of the prong like projections 72A, 72B. The main body 70 of the second fastening element 54 also includes a central aperture 76 that is adapted to seat a portion of the fastener 80. The main body also includes a pair of cut-out portions 78 that form a pair of outwardly projecting tabs 78A, 78B.

The illustrated cord 40 has a first end 40A that is disposed between the first and second fastening elements 52, 54. When the first fastening element 52 and the second fastening element 54 are aligned and disposed in registration with each other, the prong like projections 60A, 60B and 72A, 72B form in essence a channel that surrounds and seats the first end 40A of the cord 40. The first end 40A of the cord 40 also extends into and is crimped or mechanically retained between the outwardly projecting tabs 68, 78A, and 78B of the fastening elements, as shown in phantom in FIG. 3. The assembly of the first and second fastening elements (i.e., fastening mechanism) is then retained within the channel 30 of the main housing 20 by the fastener 80. The fastener 80 is sized and configured to seat within a fastener aperture 84 that is formed within a central portion of the main housing 20. The illustrated cord 40 also includes a second end 40B (FIG. 1) opposite to the first end 40A that includes a fastening structure suitable for removably securing the cord to the hockey stick 14. According to one practice, the second end of the cord is secured or coupled to a loop structure 42 that can be removably and replaceably secured to the hockey stick. The loop structure preferably includes a hook and loop type of attachment mechanism that allows the loop to be coupled to the hockey stick. Those of ordinary skill in the art will readily recognize that the cord 40 can be formed of any suitable flexible, resilient material, such as by an elastic material. One or more ends of the cord 40 can be thicker relative to the other end. In particular, the first end 40A of the cord 40 can be thicker than the second end to help ensure that the cord is sufficiently retained within the main housing 20 of the device, thus reducing the likelihood of an accidental separation of the cord from the main housing 20 during use.

The fastening elements 52, 54 of the fastening mechanism 50 allow the cord 40 to be easily secured to the device main housing and to be easily removed therefrom, such as when the cord needs to be replaced.

I claim:

1. A sports training device, comprising:

a circular main housing having opposed top and bottom surfaces each having a plurality of bosses formed thereon, a channel formed within an intermediate housing section of the main housing and extending therethrough, a fastening mechanism seated within the channel and secured to the main housing by a fastener, wherein the fastener mechanism includes a first fastener part and a separate and independent second fastener part, wherein the first fastener part and the second fastener part can be coupled together, and a cord element having a first end portion mounted between the first fastener part and the second fastener part and being mechanically retained therebetween, wherein the cord element extends outwardly from the channel, wherein the first fastener part comprises a main body having a first end that includes a first skirt portion and an opposed second end that has a second skirt portion that forms a lip portion, wherein the lip portion projects in a direction opposite to a projection direction of first skirt portion, and one or more cut-out portion that forms an outwardly projecting tab, and wherein the second fastener part comprises a main body having a first end that includes a first skirt portion and an opposed second end that has a skirt portion that forms a lip, wherein the lip portion projects in a direction opposite to a projection direction of the first skirt portion, and one or more cut-out portions that form a pair of outwardly projecting tabs that are axially spaced apart along the main body.

2. The sports training device of claim 1, wherein the main housing has a first housing section forming the top surface and a second housing section forming the bottom surface, wherein the intermediate section is disposed between the first and second housing sections, and wherein the intermediate housing section is composed of first and second intermediate components.

3. The sports training device of claim 1, wherein the main housing has a fastener receiving aperture formed therein and the first fastener part and the second fastener part each have a fastener receiving aperture formed therein, wherein when the first and second fastener parts are mounted within the channel, the fastener receiving apertures of the main housing and the first and second fastener parts are disposed in registration with each other for receiving a fastener for retaining and securing the first and second fastener parts within the channel.

4. The sports training device of claim 1, wherein each of the first skirt portions of the first fastener part and the second fastener part has a pair of prong like projections.

5. The sports training device of claim 1, wherein the outwardly projecting tab of the first fastener part is disposed between the pair of outwardly projecting tabs of the second fastener part when the first and second fastener parts are mounted together within the channel of the main housing.

* * * * *